US007707858B2

(12) United States Patent
Jeon et al.

(10) Patent No.: US 7,707,858 B2
(45) Date of Patent: May 4, 2010

(54) WASHING MACHINE AND LINT REMOVING APPARATUS THEREOF

(75) Inventors: Si Moon Jeon, Seoul (KR); Young Hwan Park, Seoul (KR)

(73) Assignee: LG Electronics Inc., Seoul (KR)

( * ) Notice: Subject to any disclaimer, the term of this patent is extended or adjusted under 35 U.S.C. 154(b) by 816 days.

(21) Appl. No.: 11/228,709

(22) Filed: Sep. 15, 2005

(65) Prior Publication Data

US 2006/0075790 A1 Apr. 13, 2006

(30) Foreign Application Priority Data

Oct. 7, 2004 (KR) ..... 10-2004-0080069

(51) Int. Cl.
*D06F 18/00* (2006.01)

(52) U.S. Cl. ..... 68/3 R; 68/20

(58) Field of Classification Search ..... 68/12.04, 68/12.05, 12.06, 12.12, 12.18, 12.19, 16, 68/17 R, 18 R, 19, 19.1
See application file for complete search history.

(56) References Cited

U.S. PATENT DOCUMENTS 3,896,641 A * 7/1975 Worst ..... 68/17 R
2004/0216326 A1* 11/2004 Kitamura et al. ..... 34/597

FOREIGN PATENT DOCUMENTS

| | | | |
|---|---|---|---|
| CN | 1507514 | | 6/2004 |
| EP | 0870859 | | 10/1998 |
| GB | 1554725 | * | 10/1975 |
| GB | 2 181 222 | * | 4/1987 |
| GB | 2 223 240 | * | 4/1990 |
| GB | 2 262 595 A | | 6/1993 |
| GB | 2262595 | | 6/1993 |
| JP | 2002-200395 | | 7/2002 |
| KR | 1020030020763 | | 3/2003 |

* cited by examiner

*Primary Examiner*—Frankie L Stinson
(74) *Attorney, Agent, or Firm*—Lee, Hong, Degerman, Kang & Waimey

(57) ABSTRACT

A washing machine is provided. The washing machine includes a detergent box, a housing, and a filter. The detergent box is installed on one side of a main machine and connected to a flowing path of an exhaust duct through which air is exhausted. The housing is detachably installed in the detergent box. The filter is installed in the housing to collect lint while the exhaust air passes through the filter.

13 Claims, 7 Drawing Sheets

WASHING MACHINE AND LINT REMOVING APPARATUS THEREOF

CROSS-REFERENCE TO RELATED APPLICATIONS

Pursuant to 35 U.S.C §119(a), this application claims benefit of earlier filing date and right of priority to Korean Application No. 80069/2004, filed Oct. 7, 2004, the contents of which are hereby incorporated by reference herein in their entirety.

BACKGROUND OF THE INVENTION

1. Field of the Invention

The present invention relates to a washing machine, and more particularly, to a washing machine and a lint removing apparatus thereof capable of easily collecting lint generated from the laundry during a washing cycle and easily disposing the collected lint. More particularly, the present invention relates to a washing machine and a lint removing apparatus thereof capable of enhancing clearness of the laundry by allowing lint conveyed in dry air during a dry cycle of the laundry to be collected by a predetermined filter structure.

2. Description of the Related Art

A general drum washing machine includes a main body having a hexahedral shape, a drum installed in the main body and having a plurality of holes, a tub enclosing the drum and in which washing water is taken, a drive motor for rotating the drum, and a detergent box for receiving detergent, a water pipe connected with the detergent box, for supplying the washing water or the washing water mixed with the detergent of the detergent box, a drain pipe for draining the washing water used in a washing cycle to the outside, and a pump and a drain hose connected with the end of the drain pipe, for forcibly draining the washing water.

The drum washing machine puts the laundry, supplies the washing water into the drum and performs the washing cycle using friction with the washing water produced while the laundry falls in a gravity direction when the drum rotates. Recently, the drum washing machine has an additional function and can perform a spinning and dry cycles for the laundry after the washing cycle besides the washing cycle.

The washing machine that performs the dry cycle has a ventilation duct installed on one side of the tub to allow hot wind to be blown to the laundry in the drum after the spinning cycle for the laundry and allow humidity of the laundry to be evaporated by the hot wind. During the dry cycle, air containing humidity is exhausted to the outside of the washing machine through an exhaust port. In the meantime, since the exhaust port is extended to the outside of the main body so that outside air may communicate with the inside of the tub, it also serves as a respiration hole when an infant or a pet is confined in the tub.

In the washing machine having a dry function, lint (fine fluff generated from the laundry) is produced from the laundry when the dry cycle is performed. The lint is circulated in the drum within the washing machine by hot wind and discharged through the exhaust port to the outside of the washing machine together with the exhausted air. However, since the lint has weight and volume of its own though it is fine, the lint is accumulated in a position adjacent to the exhaust port, particularly in a bellows for connecting the exhaust port with the tub.

When the lint is constantly accumulated, it blocks the exhaust port after all, which hinders the hot wind from circulating during the dry cycle, so that not only dry efficiency is deteriorated but also the dry condensed lint has danger of catching fire due to the hot wind thereof. Also, since the exhaust port cannot properly serve as a respiration hole due to the lint when an infant or a pet is confined in the washing machine, stability of the washing machine is damaged.

Considering the above problems, a filter for filtering the lint has been suggested to prevent the lint from being accumulated in the exhaust port. The filter has a predetermined shape and is inserted into the exhaust port, so that when the lint is condensed more than a predetermined amount, a user may easily replaces the filter.

However, when the filter and the adjacent portion of the filter are not strongly bonded in such a structure, the lint leaks through a gap between them, leaking out together with the hot wind. Further, the leaked hot wind distorts or wrenches each part of the washing machine made of synthetic resin and thus transforms the appearance. Such problems have an influence on each part constituting the washing machine and deteriorate reliability of the product.

Also, since a user should take down the adjacent portion of the exhaust port to remove the lint, it is difficult to clean the filter. Further, if a user does not clean the filter frequently because cleaning the filter is not easy, collected lint becomes an obstacle to the flowing of air. Accordingly, dry efficiency for the laundry is deteriorated and heat is accumulated in the inside of the tub and thus danger of catching fire increases. Also, since the exhaust port cannot properly serve as a respiration hole when the lint is excessively accumulated, the lint becomes an obstacle to the safety of the washing machine.

SUMMARY OF THE INVENTION

Accordingly, the present invention is directed to a washing machine and a lint removing apparatus thereof that substantially obviate one or more problems due to limitations and disadvantages of the related art.

An object of the present invention is to provide a washing machine and a lint removing apparatus thereof capable of allowing hot wind supplied from a ventilation fan to be swiftly circulated in a tub and exhausted to an exhaust port by having lint generating during a dry cycle not accumulated in the exhaust port.

Another object of the present invention is to provide a washing machine and a lint removing apparatus thereof capable of allowing a user to easily clean a filter.

A further another object of the present invention is to provide a washing machine and a lint removing apparatus thereof capable of preventing danger of catching fire, danger of safety, deterioration of dry efficiency, which might be generated when lint is accumulated in an exhaust port, by having the lint not accumulated at the filter.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a washing machine including: a washing machine main body having open one side; a tub received in the main body; a drum rotatably provided in the tub; a ventilation duct for allowing air to flow to the tub; an exhaust duct through which exhaust air is discharged to an outside of the tub; a detergent box disposed on one side of the main body and connected with one path of the exhaust duct; a housing detachably installed in the detergent box; and a filter installed in the housing, for collecting lint while the exhaust air passes through the filter.

In another aspect of the present invention, there is provided a washing machine including: a washing machine main body having open one side; a tub received in the main body; a drum rotatably provided in the tub; a ventilation duct for allowing air to flow to the tub; an exhaust duct through which exhaust air is discharged to an outside of the tub during a dry cycle; a housing drawn out to a front side of the main body; and a filter provided to the housing and through which air flowing in the exhaust duct passes.

In a further another aspect of the present invention, there is provided a washing machine comprising: a washing machine main body having open one side; a tub received in the main body; a drum rotatably provided in the tub; a ventilation duct for allowing air to flow to the tub; an exhaust duct through which exhaust air is discharged to an outside of the tub during a dry cycle; a detergent supply unit installed in the main body and connected with at least a water pipe and the exhaust duct; and a filter provided to the detergent supply unit, for filtering air in the exhaust duct.

In a still further another aspect of the present invention, there is provided a lint removing apparatus of a washing machine, including: a washing machine main body; a housing provided to one side of the main body, for receiving detergent; and a filter provided to one side of the housing, for removing lint conveyed in air exhausted after a laundry is dried.

The washing machine and the lint removing apparatus thereof have an advantage of easily removing and disposing the lint generated from the laundry. Since the lint can be easily removed, danger of catching fire reduces and safety is improved.

Also, the lint filter is provided to a position adjacent to the detergent insertion member, which makes the appearance elegant and the structure simple.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

First Embodiment

Figure 1:
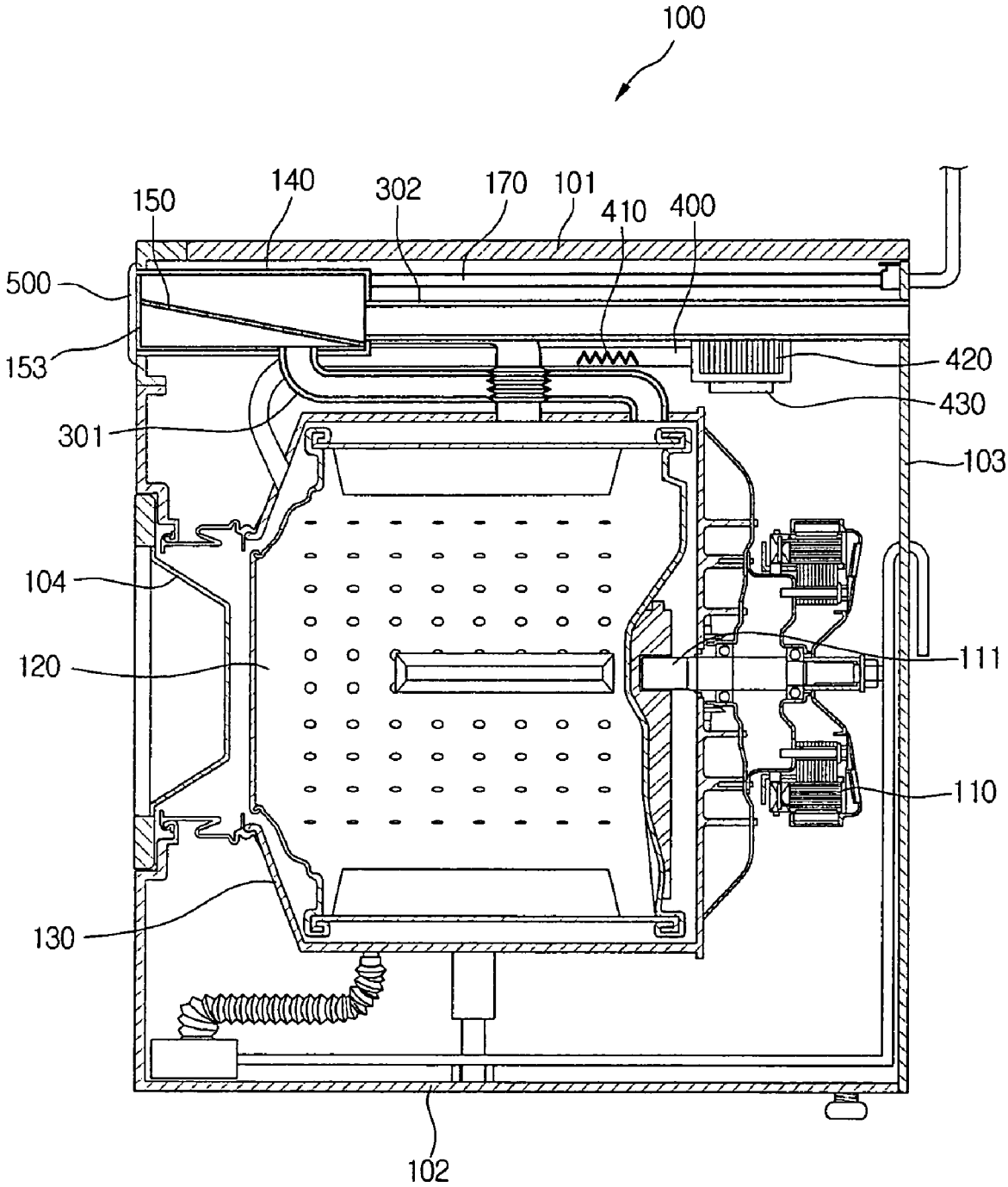
FIG. 1 is a sectional view of a washing machine according to the present invention.
Figure 2:
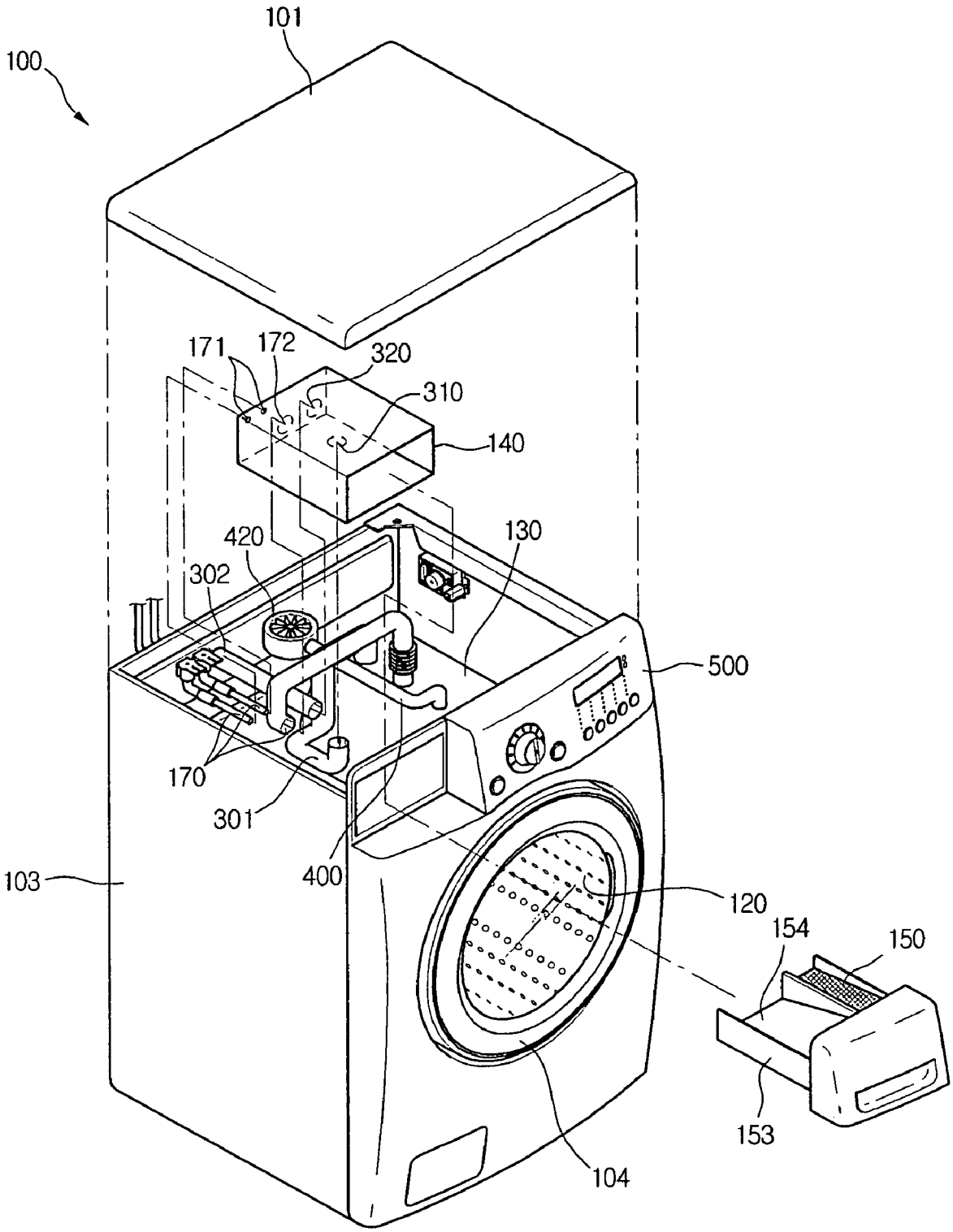
FIG. 2 is an exploded perspective view of a washing machine according to the present invention.

FIG. 1 is a sectional view of a washing machine according to the present invention and FIG. 2 is an exploded perspective view of a washing machine according to the present invention.

Referring to FIGS. 1 and 2, the washing machine 100 includes an upper plate 101, a lower plate 102, and a cabinet 103, which constitute an inner space. A plurality of devices such as a drive motor 110, a drum 120, and a tub 130 are installed in the inner space.

The drive motor 110 rotates a drive shaft 111 using a current applied from a power source unit. The drive shaft 111 is fixed in the backside of the drum 120 to rotate the drum 120 and the drum is open to the side of the door 104 so that the laundry may be inserted therein.

Also, the drum 120 is enclosed by the tub 130 and maintains airtightness against the outside lest washing water taken in the tub 130 should leak out. The drive motor 110 is installed outside the tub 130 and the drive shaft 111 extending from the drive motor 110 passes through the tub 130 and is fixed in the drum 120.

Also, a ventilation duct 400 is installed in an interval between the tub 130 and the upper plate 101 to communicate with one side of the tub 130. The ventilation duct 400 is intended for supplying hot air to the inside of the tub 130 when the laundry is dried and has a ventilation fan 420 for forcibly blowing air to the tub 130. A motor 430 to which outside power is applied under control of a controller 500 operates the ventilation fan 420. A heater 410 is installed in the inside of the ventilation duct 400 to allow air blown from the ventilation fan 420 to the tub 130 to change into hot dry wind while passing through the heater 410.

Also, a detergent box 140 is provided to the front side of the washing machine. The detergent box 140 has a box shape whose one side is open and a housing 153 is detached through the open side. The detergent box 140 is provided in the form of a predetermined structure fixed in the inside of the washing machine. The housing 153 can be selectively received in the detergent box 140 and drawn out when a user intends to insert the detergent or clean the filter 150. Since the detergent box 140 and the housing 153 can supply the detergent, the above two parts can be named as a detergent supply unit.

In detail, the detergent box 140 has an inlet port 171 connected with a water pipe 170 on its one side to allow water supplied into the detergent box 140 to be guided to the housing 153 and mixed with the detergent therein. The detergent box 140 also has a water port 172 formed on the other side and provided as a passage through which the detergent mixed with the water in the housing 153 is supplied to the tub 130.

Also, the detergent box 140 has an suction port 310 formed on its one side to allow air exhausted from the tub 130 to flow in through the first exhaust duct 301. The detergent box 140 has an exhaust port 320 formed on the other side to allow air lint-filtered by the filter to be exhausted through the second exhaust duct 302. Though the exhaust ducts are discriminated as 301 and 302, they are the same in substantially guiding the air inside the tub 130 to the outside of the washing machine.

They are merely discriminated as the pipe through which the air before passing through the filter 150 flows and the pipe through which the air after passing through the filter 150 flows.

Also, the housing 153 is divided into a detergent insertion region 154 into which the detergent and fiber softener are inserted and a filter region 155 by which lint in the air exhausted from the tub 130 is filtered. Of course, the filter region 155 has a filter 150 to allow the lint conveyed in the air to be filtered.

In operation, when the laundry is input in the drum 120 and the washing water is supplied to the tub 130 until the laundry is immersed in the water more than a predetermined level, the drive motor 110 and the drive shaft 111 rotate under control of the controller 500. At this point, since the drive shaft 111 is fixed in the drum, the drum 120 rotates together.

When the drum 120 rotates, the laundry falls into the washing water while rotating along the inner surface of the drum 120. When the above series of processes is repeated and the washing cycle is completed, the washing water is drained and the spinning cycle starts. During the spinning cycle, the drum 120 rotates in high speed with no washing water in the tub 130 and the washing water remaining in the laundry is forcibly moved to the outside by centrifugal force of the rotating drum.

When the spinning cycle is finished, the rinsing cycle and the spinning cycle are repeatedly performed several times so that the detergent is completely removed from the laundry.

When the washing cycle, the rinsing cycle, and the spinning cycle are finished, the dry cycle for the laundry from which water has been removed starts.

In detail, when the motor 430 rotates and the laundry is agitated, the ventilation fan 420 operates to blow air into the tub 130. At this point, since a heater 410 is installed in the inside of the ventilation duct 400, the air moving into the tub 130 changes into hot and dry air and is supplied to the tub 130. Since the hot and dry air is supplied into the tub 130, the laundry in the drum 120 is more swiftly dried. The air used in drying the laundry is exhausted through the exhaust ducts 301 and 302 to the outside of the washing machine.

Here, the exhaust air is guided to the detergent supply unit, more particularly, to the filter 150 through the first exhaust duct 301, so that the lint conveyed in the air is removed. After the filter 150 removes the lint, the lint is discharged through the second exhaust duct 302 to the outside of the washing machine.

When the dry cycle is performed several times, the lint is collected at the filter 150 and when the collected lint reaches a large amount, a user removes the lint. The number of times a user should remove the lint from the filter 150 can be known by a user's experience. Removing the lint from the filter 150 can be automatically performed using various detection sensor such as a pressure sensor provided to the inside of the exhaust duct 302. In the case where a pressure is automatically measured by a pressure sensor, a difference between pressures before and after the air passes through the filter 150 is measured. If a large pressure drop is generated by the filter 150, it may be judged the lint has been excessively accumulated.

When the lint is collected much at the filter 150, the housing 153 installed in the front side of the washing machine is drawn out to the front and separated from the detergent box 140 in order to dispose the collected lint. After that, the filter 150 installed in the filter region 155 of the housing 153 is separated and the lint is removed from the filter 150. Here, the filter 150 is provided to the housing 153 and can be separated from the housing 153 in a sliding manner.

Since the exhaust air from the tub 130 passes through the detergent supply unit, which is a unit into which the detergent is inserted, a user can clean the filter 150 by separating the housing from the detergent box as in separating the housing in order to insert the detergent. Therefore, a user can remove the lint more conveniently. Also, since a user can observe the state of the filter 150 each time inserting the detergent when performing the washing cycle, a user can conveniently see accumulated lint to clean the filter 150. Of course, before a user starts the washing cycle, a user may observe the filter with his natural eyes and clean the filter 150 if necessary.

According to the present invention, it is possible to prevent danger of catching fire, concern of safety, and dry efficiency deterioration that might be generated due to the lint from the washing machine.

Figure 3:
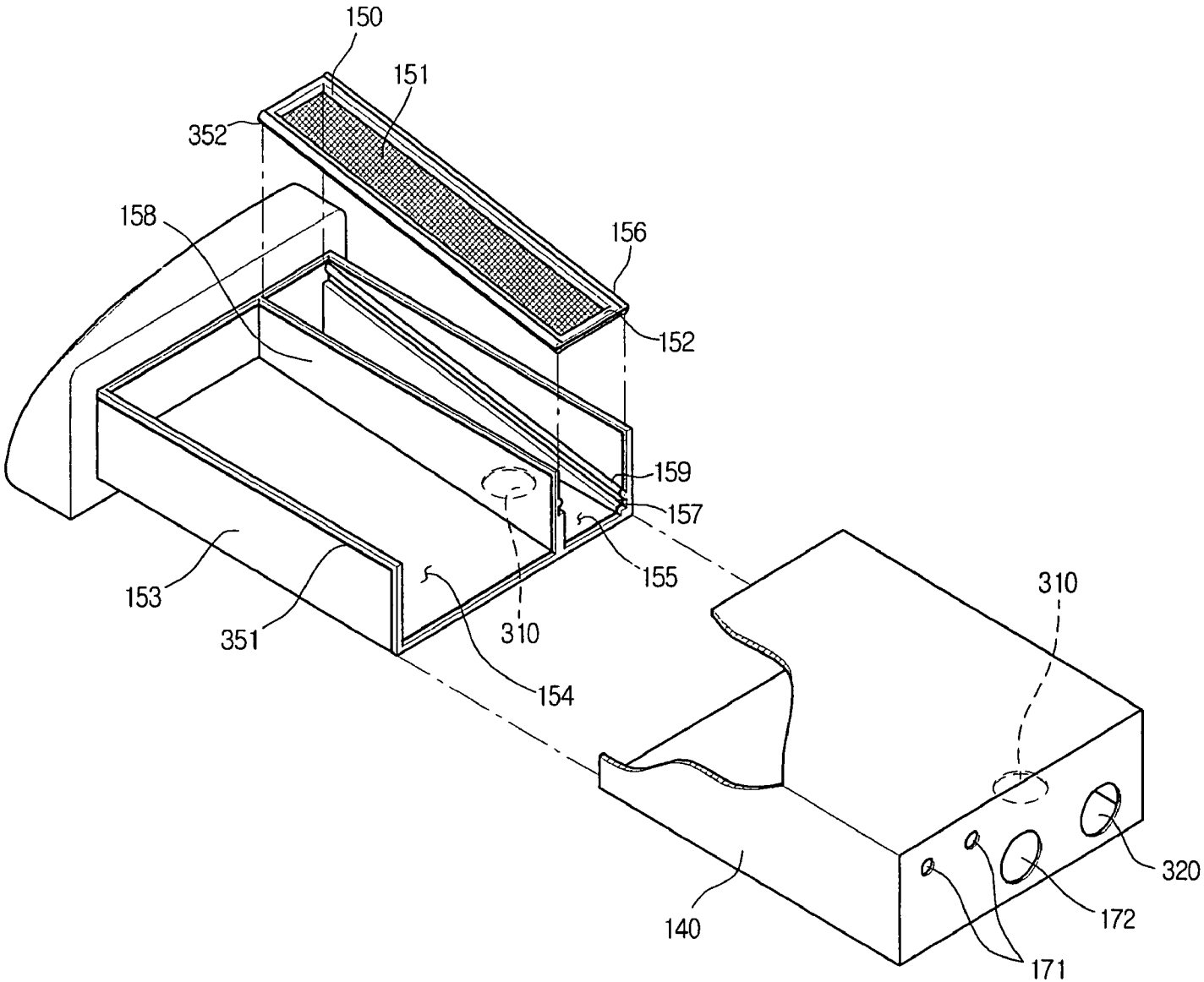
FIG. 3 is an exploded perspective view of a detergent supply unit according to the present invention.
Figure 4:
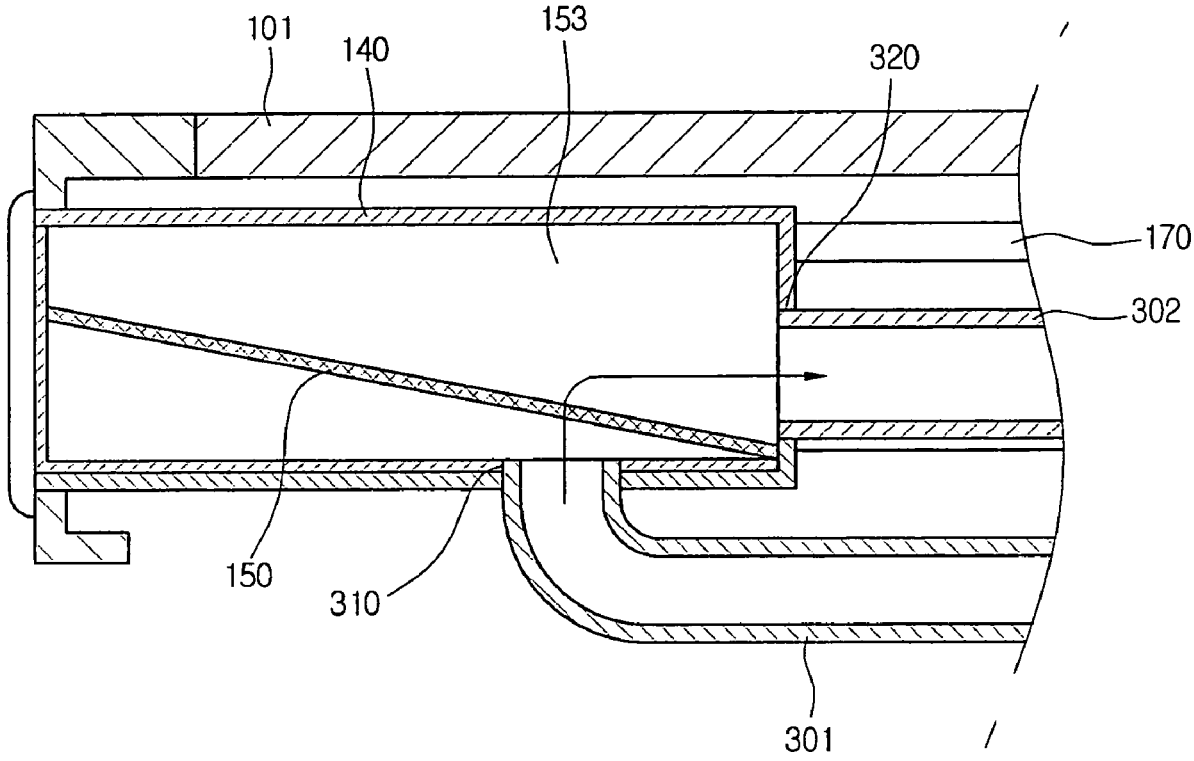
FIG. 4 is a sectional view of a detergent supply unit according to the present invention.

FIG. 3 is an exploded perspective view of a detergent supply unit according to the present invention and FIG. 4 is a sectional view of a detergent supply unit according to the present invention.

Referring to FIGS. 3 and 4, the detergent box 140 and the housing inserted in the detergent box are illustrated. As described above, the housing 153 is drawn out when the detergent is supplied so that the detergent may be inserted. After the detergent is inserted, the housing 153 is pushed into the detergent box 140 so that the detergent may be mixed with water and supplied to the tub 130. The housing 153 can be inserted into the detergent box 140 in a sliding manner. A sealer for airtightness is further installed at the boundary between the detergent box 140 and the housing 153.

Also, the inner space of the housing 140 is divided into the detergent insertion region 154 into which the detergent is inserted and the filter region 155 in which the filter 151 is installed. The detergent insertion region 154 and the filter region 155 can be partitioned by a partition 158 integrally formed in the housing 153. Therefore, since the detergent region for receiving the detergent and the filter region for filtering the lint are simultaneously exposed to the outside when a user opens the housing 153 in order to supply the detergent, a user can see how mach the lint has accumulated at the filter 150 with his natural eyes as well as insert the detergent. Of course, when it is checked that the lint has accumulated much, a user can clean the filter 150 immediately.

Also, a guide 157 and a threshold 159 are formed on the inner wall of the housing 153 that provides the filter region 155 so that the filter 150 may be installed and fixed therein. The filter 150 has dense meshes capable of filtering the lint and has a filter supporter 152 for enclosing the outline of the filter 152 to support the filter 150. The filter support 152 has a sealer 352 provided to the outer edge thereof so that the boundary between the inner surface of the housing 153 and the filter 150 is sealed.

Interaction between the filter region 155 and the filter 150 will be described below. First, the filter support 152 is guided by the guide 157 formed in the filter region 155 of the housing 153. The guide 157 is sloppily and vertically formed on the inner wall of the filter region 155 so that the filter support 152 may be stably supported. Also, the filter support 152 has a hooker 156 formed on both edges thereof. One end of the hooker 156 is disposed to match the guide 157 formed on the inner surface of the filter region 155 and pushed further so that the filter 150 may be fixed in the filter region 155.

An arrow in FIG. 4 illustrates a flowing direction of the air from the tub 130. After the lint is removed by the filter 150 while the air flowing through the first exhaust duct 301 passes through the filter 150 from the downward direction to the upward direction, the air is exhausted through the second exhaust duct 302 to the outside of the washing machine. Of course, the space in the filter region 155 that is provided to the downward of the filter 150 forms the space in which the lint is accumulated.

Second Embodiment

In the lint removing apparatus of the washing machine according to the first embodiment of the present invention, the detergent insertion region 154 and the filter region 155 are integrally provided to the housing 153. In other words, when a user opens the housing 153 in order to insert the detergent, the space for receiving the detergent and the space in which the filter 150 is disposed are simultaneously exposed.

In that case, the filter 150 might be stained with the detergent and thus contaminated while the detergent is inserted. Considering this problem, the second embodiment divides the housing into a plurality of parts, so that the operation of inserting the detergent and the operation of cleaning the filter can be performed separately.

Figure 5:
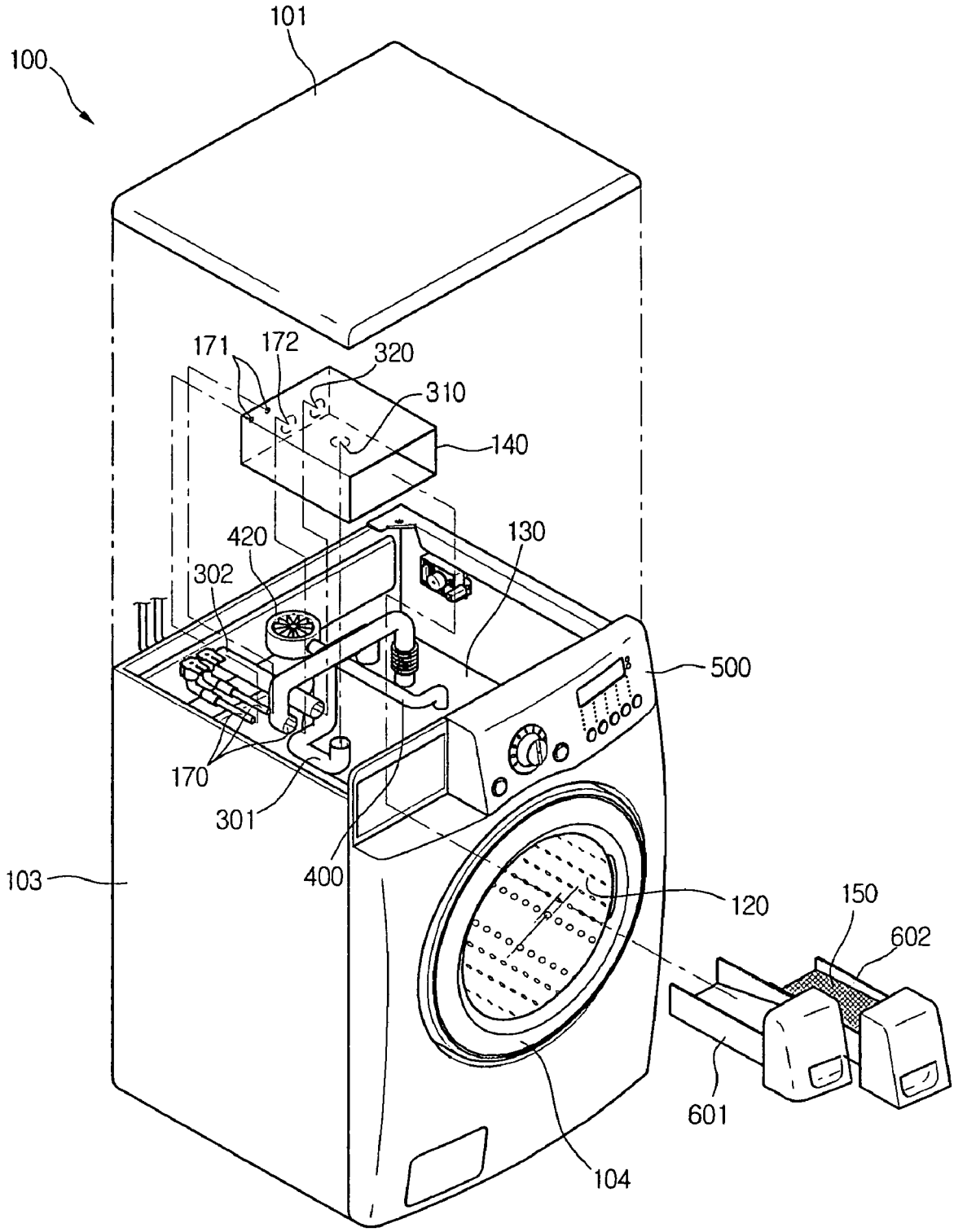
FIG. 5 is an exploded perspective view of a washing machine according to the second embodiment of the present invention.

FIG. 5 is an exploded perspective view of a washing machine according to the second embodiment of the present invention.

Referring to FIG. 5, the second embodiment of the present invention is the same as the first embodiment except the construction relating to the housing 153. In detail, the housing 153 is not provided in an integral type. Instead, the housing can be divided into the first drawer 601 drawn when the detergent is inserted and the second drawer 602 drawn when the filter 150 is cleaned. Therefore, the problems that the filter is stained with the detergent or wet with water are removed.

The drawers 601 and 602 can be inserted into or drawn out from the detergent box 140 in a sliding manner.

When the detergent is inserted, the first drawer 601 is drawn out so that the detergent may be inserted. On the contrary, when the filter is cleaned, the second drawer 602 is drawn out so that the filter may be cleaned.

For other embodiment, the detergent box 140 may be divided into two parts. In that case, since a plurality of parts are provided, concern that the air and the water mixes to each other reduces but the construction of the product is complicated.

Third Embodiment

The third embodiment of the present invention is the same as the first and second embodiments except a filter 150 and a manner the filter 150 is supported. The third embodiment allows larger amount of lint to be filtered and an amount of lint collected in the filter region 155 to be increased by improving the filtering manner of the filter 150 of the first embodiment. The relevant descriptions of the first and second embodiments can be directly quoted for parts not described in detail in the third embodiment.

Figure 6:
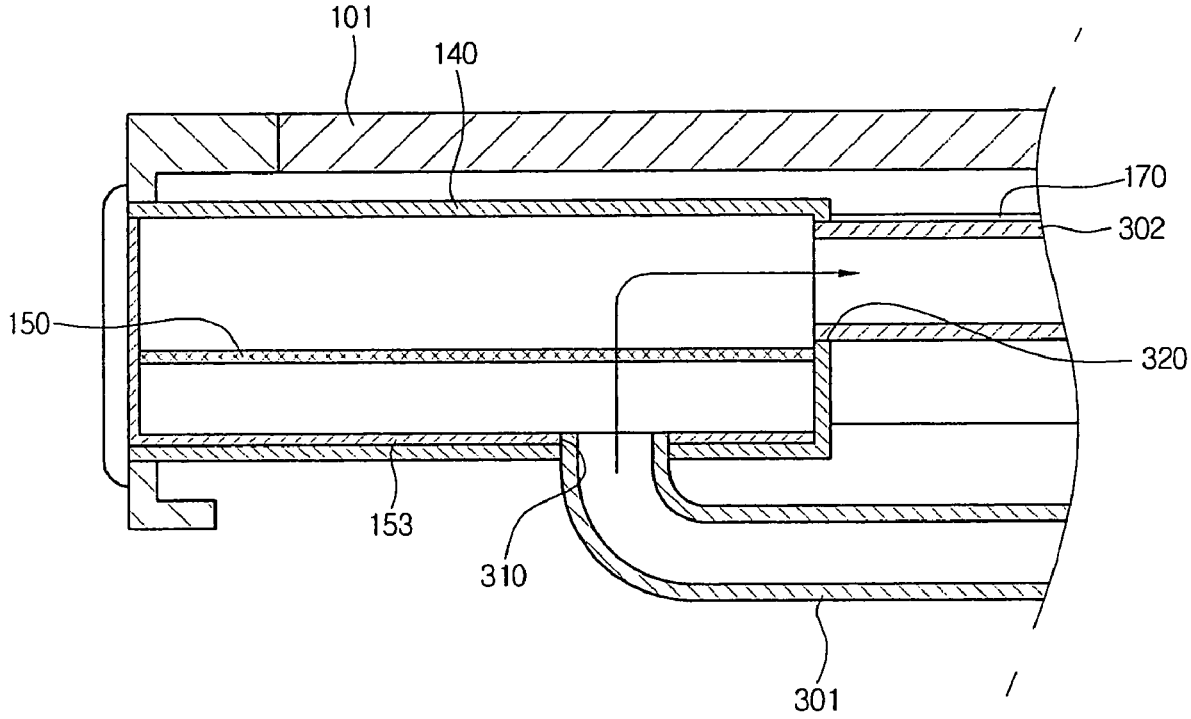
FIG. 6 is a sectional view of a lint removing apparatus according to the third embodiment of the present invention.

FIG. 6 is a sectional view of a lint removing apparatus according to the third embodiment of the present invention.

Referring to FIG. 6, a filter region 155 of a housing 153 is partitioned into an upper part and a lower part by a filter 150. A suction port 310 and an exhaust port 320 formed in a detergent box 140 may be formed in the lower part and the upper part, respectively.

With such a construction, air from the first exhaust duct 301 is distributed over a relatively wide area of the filter 150 and contacts the filter 150 and the space for accommodating the lint that is provided to the lower part of the filter 150 can be widened.

Fourth Embodiment

The fourth embodiment of the present invention is the same as the first through third embodiments except the structure of the filter.

Figure 7:
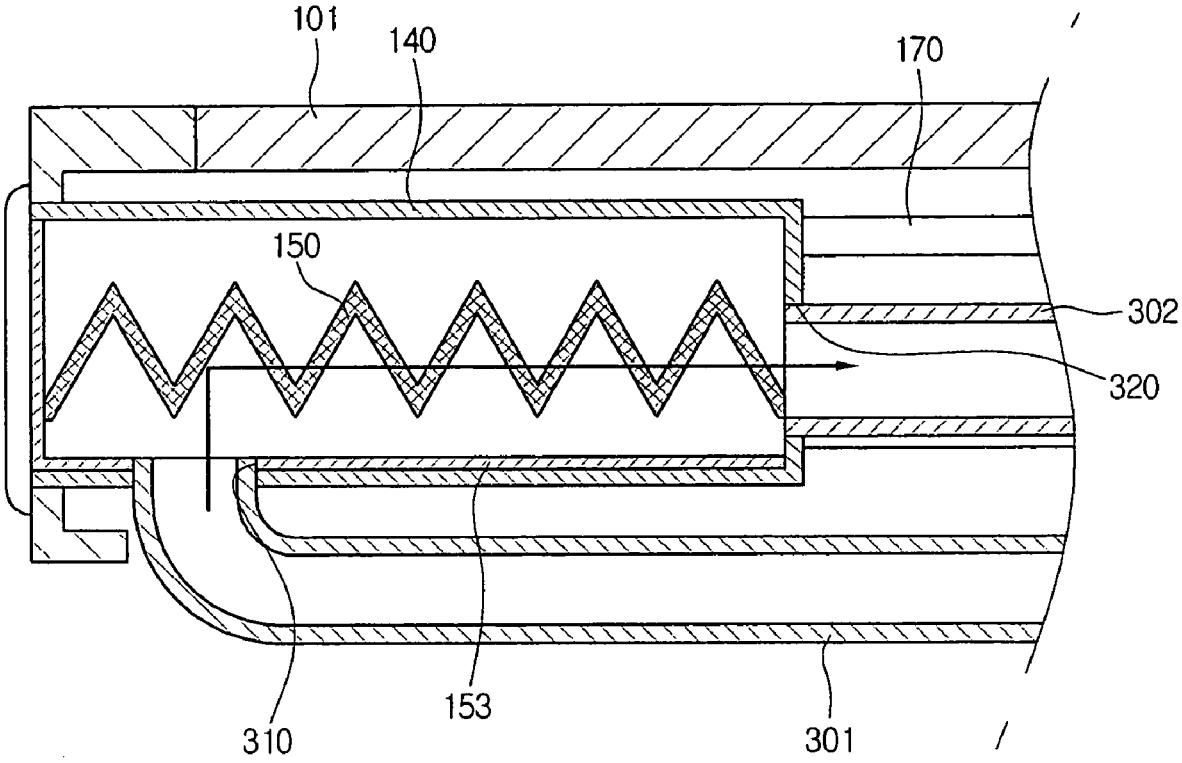
FIG. 7 is a sectional view of a lint removing apparatus according to the fourth embodiment of the present invention.

FIG. 7 is a sectional view of a lint removing apparatus according to the fourth embodiment of the present invention.

Referring to FIG. 7, a filter 150 is provided in a zigzag shape.

When the filter 150 is provided in the zigzag shape, a suction port 310 and an exhaust port 320 may be respectively formed on positions spaced apart a relatively long distance because it is desirable that air passing through the zigzag-shaped filter 150 is distributed over the entire area of the filter and passes through the filter. Also, even when the filter 150 is provided in various shape having bending portions, not the zigzag shape, it makes no difference in the efficiency of the filter.

It is easily expected that filtering efficiency of the filter 150 improve according to the fourth embodiment.

According to the present invention, a user can easily draw out the filter to the front side of the washing machine to clean the filter periodically or when the filter needs cleaning.

According to the present invention, the lint is not accumulated in the exhaust duct and can be easily collected and disposed by a user. Therefore, dry efficiency is enhanced during the dry cycle of the washing machine, the danger of catching fire reduces, and safety of the washing machine improves.

Also, since a user can draw out the filter from the front side of the washing machine to remove the lint whenever necessary, treatment thereof is simple.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A washing machine comprising:

a washing machine main body having open one side;

a tub received in the main body;

a drum rotatably provided in the tub;

a ventilation duct for allowing air to flow to the tub;

a drain duct connected to the tub to allow water from the tub to be drained out of the washing machine;

a first exhaust duct directly coupled between the tub and a detergent box for introducing exhaust from the tub to the detergent box having a detachable housing configured for removably receiving a filter and comprising a compartment for holding detergent;

a filter configured for collecting lint from the exhaust that passes through the filter after going through the suction duct; and a second exhaust duct for directing the exhaust out of the washing machine after the exhaust passes through the filter, without reintroducing the exhaust back into the tub.

2. The washing machine according to claim 1, wherein the filter comprises a net and a filter supporter forming an outline of the net.

3. The washing machine according to claim 1, wherein the filter is freely detachable from the housing.

4. The washing machine according to claim 1, wherein the housing comprises an integral body partitioned into a detergent insertion region for receiving detergent and a filter region in which the filter is disposed.

5. The washing machine according to claim 1, wherein the housing comprises a divided body having a first draw port for receiving detergent and a second draw port in which the filter is installed.

6. The washing machine according to claim 1, wherein the filter is received into and drawn out from the housing in a sliding manner.

7. The washing machine according to claim 1, wherein the filter divides an inner space of the housing into two equal parts.

8. The washing machine according to claim 1, wherein the filter is disposed in the housing in a tilted position with respect to a bottom surface of the housing.

9. The washing machine according to claim 1, wherein the filter is disposed horizontally in the housing.

10. The washing machine according to claim 1, wherein the filter is bent.

11. The washing machine according to claim 1, wherein the housing is received into and drawn out from the detergent box in a sliding manner.

12. The washing machine according to claim 1, wherein the detergent box is received into and drawn out from a front side of the washing machine.

13. A washing machine comprising:

a washing machine main body having an open side;

a tub disposed in the main body;

a drum rotatably installed in the tub;

a ventilation duct for allowing air to flow to the tub;

a drain duct connected to the tub to allow water from the tub to be drained out of the washing machine;

a first exhaust duct for introducing the air from the tub to a detergent supply unit installed in the main body; and a second exhaust duct for directing the air introduced to the detergent supply unit to a component of the washing machine that is external to the tub, after the air has traveled through a filter provided in the detergent supply unit.

* * * * *